US005458930A

United States Patent [19]

Brown

[11] Patent Number: 5,458,930

[45] Date of Patent: Oct. 17, 1995

[54] DECORATIVE ARTICLE AND METHOD OF MAKING THE SAME

[75] Inventor: Dennis F. Brown, Orange, Conn.

[73] Assignee: Milford Heirloom Image, Inc., Milford, Conn.

[21] Appl. No.: 267,427

[22] Filed: Jun. 28, 1994

[51] Int. Cl.[6] ..... A47G 33/08

[52] U.S. Cl. ..... 428/11; 156/293; 428/13

[58] Field of Search ..... 428/11, 13; 156/293

[56] References Cited

U.S. PATENT DOCUMENTS

| | | | |
|---|---|---|---|
| 3,879,876 | 4/1975 | Morgan | 428/11 X |
| 4,173,667 | 11/1979 | Rusch | 428/11 |
| 4,309,464 | 1/1982 | Rauch | 428/11 |
| 4,592,936 | 6/1986 | Feruson | 428/11 |

*Primary Examiner*—Henry F. Epstein
*Attorney, Agent, or Firm*—St. Onge Steward Johnston & Reens

[57] ABSTRACT

A decorative article, such as an ornament, is disclosed having a housing having an indicia receiving surface, wherein the indicia receiving surface is, preferably, substantially planar and at least partially recessed inside the housing. Indicia, having a front face, is at least partially disposed on the indicia receiving surface such that the face of the indicia is directed outward from the housing. An adherent adheres at least a portion of the indicia at least partially to the indicia receiving surface. A substantially transparent cover is attached to at least a portion of the front of the indicia for shielding the indicia and protecting the indicia from the environment. In the preferred embodiment, the indicia comprises a photograph. The method for making a decorative ornament includes the following steps. First a housing is provided, wherein the housing has at least an indicia receiving surface. Second, indicia, such as a photograph, is attached to at least a portion of the indicia receiving surface such that the face of the indicia faces outward from the housing. A protective covering is adhered to at least a portion of the indicia, preferably after the face of the indicia has been adhered to at least a portion of the indicia receiving surface.

15 Claims, 1 Drawing Sheet

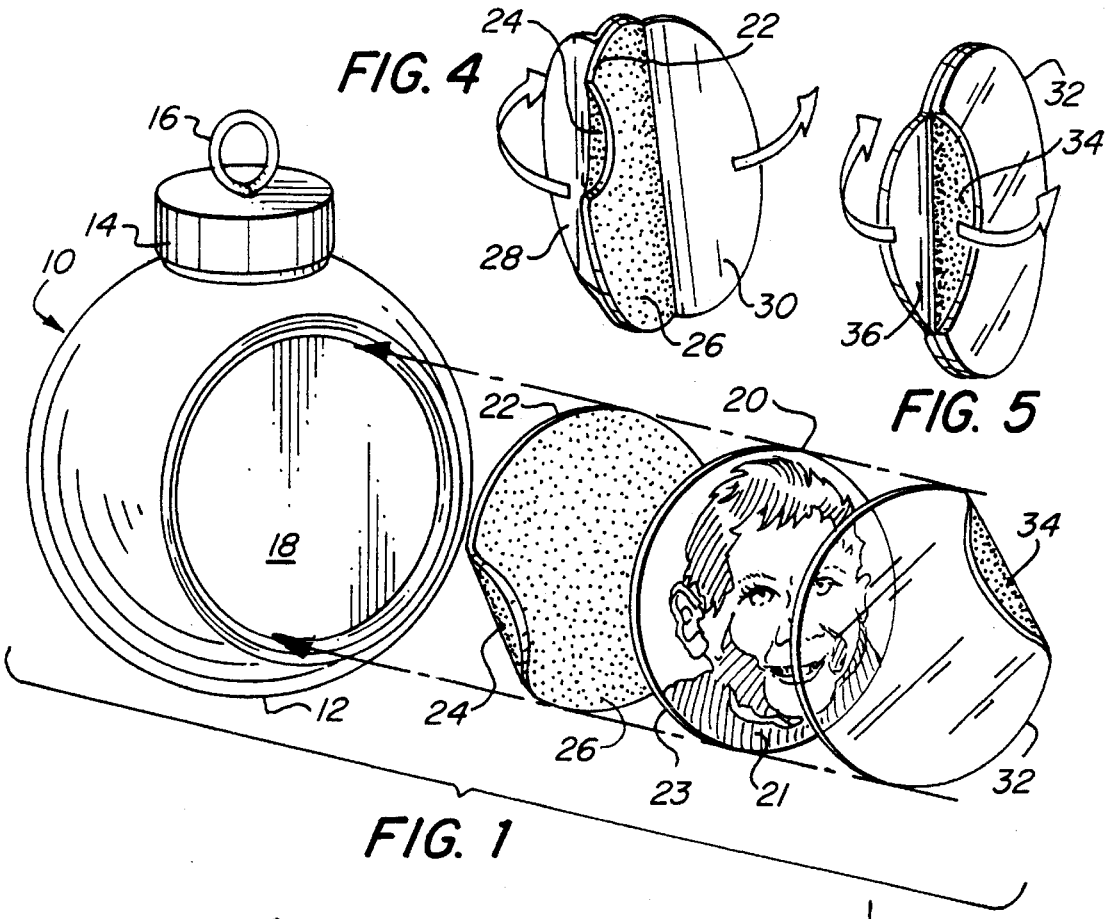
FIG. 4
24
22
28
30
26
FIG. 5
32
34
36
16
14
10
18
22
20
34
12
24
26
23
21
32
FIG. 1
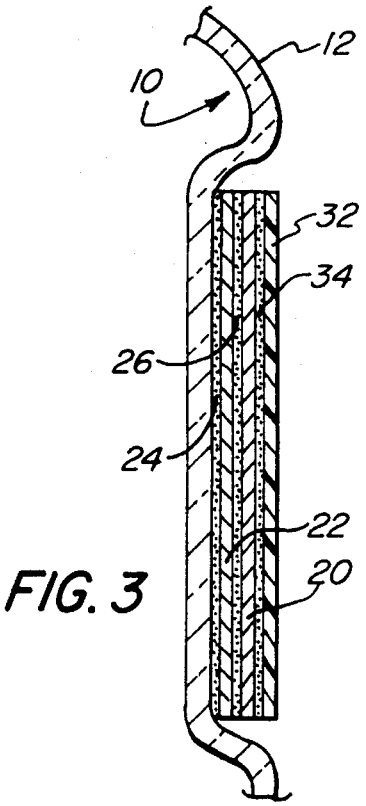
10
12
32
34
26
24
22
20
FIG. 3
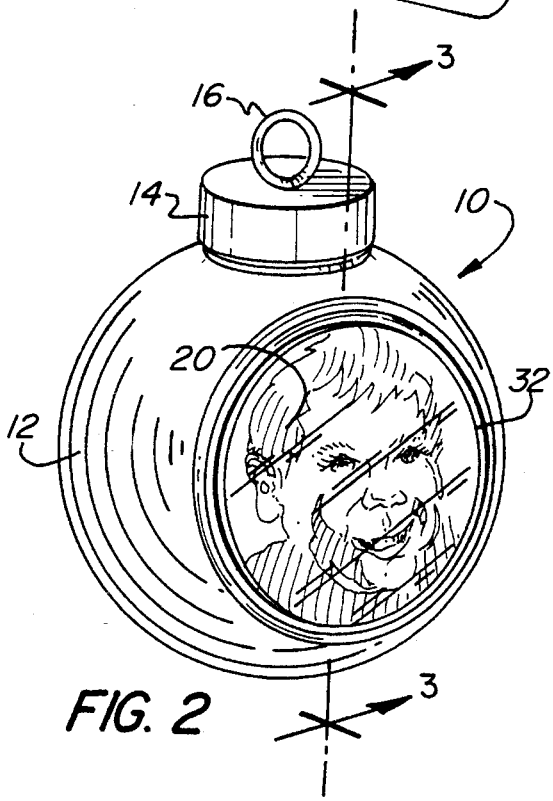
3
16
14
10
20
32
12
3
FIG. 2

DECORATIVE ARTICLE AND METHOD OF MAKING THE SAME

FIELD OF THE INVENTION

The present invention relates to decorative articles, such as ornaments, and methods of making the same.

BACKGROUND OF THE INVENTION

Decorative articles, such as ornaments, are known and are particularly popular during the Christmas season for decorating for use with tabletop centerpieces, and particularly for hanging upon limbs or branches of Christmas trees. Typical ornaments include replicas of Santa Claus, stockings, candy canes, and colored metallic balls.

However, most ornaments, such as the ones previously discussed, are unsatisfactory because they are not capable of being highly personalized.

Some ornaments, however, can be personalized to a small extent. For example, some ornaments can be monogrammed, generally to include a family surname and the date of the gift giving. This, however, is insufficient for those consumers who would like to give ornaments that are even more personalized.

Some highly personalized gifts are available, such as picture frames which include a photograph of a loved one. As is known, photographs are freely removable from the frame to allow substitution of photographs, as desired. Picture frames have a drawback in that the photograph is loosely placed inside the frame and sometimes becomes crooked. Further, the transparent covering over the photograph is unattached to the photograph, which allows the covering to also become crooked during use, sometimes exposing a portion of the photograph to the environment and subjecting the photograph to accelerated quality degradation.

What is desired, therefore, is a highly personalized decorative article which has a housing such that a photograph disposed in the housing does not become undesirably dislodged, and which has a shield for protecting the photograph such that the shield does not become undesirably misaligned with the photograph.

SUMMARY OF THE INVENTION

Accordingly, it is an object of the present invention to provide an improved decorative article.

It is another object of the invention to provide a decorative article that can be highly personalized, such as by use of a photograph.

It is yet another object of the present invention to provide a decorative article for housing a photograph such that the photograph does not become undesirably dislodged.

It is a further object to provide a decorative article having a transparent shield, wherein the shield is incapable of becoming undesirably dislodged.

To overcome the deficiencies of the prior art and to achieve the objects listed above, a decorative article is disclosed having means for permanently attaching a photograph to the article housing and means for permanently attaching a protective covering to the photograph.

By way of example, the decorative article comprises an ornament, such as one used during the Christmas season; however, other decorative articles related to other seasons could be used and nonseasonal ornaments for use year round could also be used. The decorative article comprises a housing having an indicia receiving surface. Most preferably, the indicia receiving surface is substantially flat, or planar, and is at least partially recessed within the housing.

Indicia having a front face is at least partially disposed on the indicia receiving surface such that the face of the indicia is directed outward from the housing. Preferably, the indicia comprises a photograph, having a front surface and a back surface.

An adherent adheres at least a portion of the photograph at least partially to the indicia receiving surface. A preferred adherent includes a double-sided material having an adhesive substance on both sides, sometimes commonly referred to as double-sided tape. A first and a second release material, made of any suitable material such as paper, covers the adhesive substance on the tape.

When desirable to attach the tape to the indicia receiving surface, the first release paper is peeled away from the tape and at least a portion of the exposed adhesive substance is placed in contact with the indicia receiving surface, although preferably the adhesive surface covers the entire indicia receiving surface. After the double-sided tape is positioned on the ornament indicia receiving surface, the second release paper is peeled away and at least a portion of the back surface of the photograph is placed in contact with the exposed adhesive substance, although preferably the entire back surface of the photograph is placed in contact with the exposed adhesive substance.

A substantially transparent shield is attached to at least a portion of the front surface of the photograph, but preferably covers the entire front surface of the photograph, so as to protect the photograph from degradation due to exposure to the environment. In the preferred embodiment, the shield is made of a material having an adhesive substance on one side, such as tape. A release material, such as paper, which is readily removable, covers the adhesive substance on the shield until one desires to use it.

A method for making the decorative article comprises the following steps. Generally, a housing is provided, wherein the housing has at least an indicia receiving surface. Indicia, having a front surface and a back surface, such as a photograph, is adhered to at least a portion of the indicia receiving surface such that the front surface of the indicia faces outward from the housing. A substantially transparent protective covering, or shield, is adhered to at least a portion of the front surface of the photograph.

The step of adhering the photograph to the indicia receiving surface comprises the following steps. A double-sided tape having a first and second release paper at least partially covering each underlying adhesive substance is supplied. The first release paper is removed so as to expose the first adhesive substance to the environment. At least a portion of the first side of the adhesive substance is placed in contact with the indicia receiving surface, although preferably the adhesive substance contacts all of the indicia receiving surface. The second release paper is removed so as to expose the adhesive substance to the environment. At least a portion of the back surface of the photograph is placed in contact with at least a portion of the second exposed adhesive substance, although most preferably, all of the back surface of the photograph contacts the adhesive substance.

The step of adhering the protective covering to the photograph comprises the following steps. A protective covering or shield is provided having an adhesive substance on a side and a release paper removably attached to the adhesive substance. The release paper is removed from the covering so as to expose the adhesive substance to the environment. At least a portion of the adhesive substance of the protective covering is placed in contact with the front surface of the photograph to adhere the protective covering to the photograph, although most preferably the protective covering contacts all of the front surface of the photograph.

The invention and its particular features and advantages will become more apparent from the following detailed description when considered with reference to the accompanying drawings.

BRIEF DESCRIPTION OF THE DRAWINGS

FIG. 1 is an exploded view of a decorative article, constructed in accordance with the present invention, showing a preferred method of construction;

FIG. 2 is a perspective view of the assembled article;

FIG. 3 is a cross-sectional view of the article shown in FIG. 2, taken along line 3—3, with portions broken away for clarity;

FIG. 4 is a perspective view of release paper partially removed from a double-sided adhesive material; and FIG. 5 is a perpective view of release paper partially removed from a shield having a single side of adhesive.

DETAILED DESCRIPTION OF THE DRAWINGS

Referring to the drawings in detail, a decorative article is shown and generally designated by the reference numeral 10. It should be noted that for the sake of clarity all the components and parts of article 10 may not be shown and/or marked in all the drawings. As used in this description, the terms "up", "down", "top", "bottom", etc. refer to article 10 when in the orientation illustrated in FIG. 1. Furthermore, as used in this description, the terms "front" and "back" refer to article 10 when in the orientation illustrated in FIG. 1, with "front" indicating the end of article 10 furthest to the right in FIGS. 1, 2, and more particularly the end of the article housing a photograph, as discussed herein, and "back" indicating the end of article 10 furthest to the left in FIGS. 1, 2, and, more particularly, the end opposite the photograph.

A decorative article 10, such as an ornament, is shown in FIGS. 1–3. It should be understood, however, that the ornament shown is by way of example only. Any suitable article can be used, such as seasonal articles, i.e., a pumpkin or heart, or a non-seasonal article, i.e., a circle or a square, or collectable dinner plate.

Ornament 10 comprises housing 12. Housing 12 may be constructed of any suitable material, so long as the material has the structural integrity to maintain dimensional stability. Suitable materials include plastic or wood. Preferably, a lightweight ceramic is used.

Housing 12 comprises attached cap 14 having attached ring 16. See FIGS. 1–2. Ring 16 has a diameter sufficient to receive a hook or string so that ornament 10 may be suspended from a limb of a tree (not shown), such as a Christmas tree, or otherwise placed on a larger supporting structure.

As shown in FIG. 1, housing 12 further comprises an indicia receiving surface 18. It should be understood that indicia receiving surface 18 may take any size, shape or contour, so long as it is capable of receiving and housing indicia 20. Preferably indicia receiving surface 18 is substantially flat, or planar, and at least partially recessed. Most preferably, indicia receiving surface 18 is recessed sufficiently such that after indicia 20 is placed within housing 12, indicia 20 is substantially contained within housing 12.

Indicia 20, in the preferred embodiment, comprises a photograph or other photographic image. See FIGS. 1, 2. It should be understood, however, that any suitable indicia can be used which has transferrable images. Indicia 20 has front surface, or face 21, and back surface 23 (FIG. 1). Front surface 21 faces outward from housing 12 so as to be viewable by a person.

Indicia 20 is attached to at least a portion of indicia receiving surface 18 by any suitable means such as by gluing. Most preferably, a double-sided material 22 having an adhesive substance on both sides 24, 26, commonly known as double-sided tape, is used. See FIGS. 1, 3, 4.

Most preferably, adhesive substance 24 covers the entire indicia receiving surface 18 so as to maximize the adherence of double-sided material 22 to indicia receiving surface 18. Most preferably, rear surface 23 of photograph 20 covers the entire adhesive substance 26 so as to maximize the adherence of photograph 20 to substance 26. See FIGS. 1, 4.

Release material 28, 30 is removably attached to adhesive substance 24, 26, respectively, as shown in FIG. 4. Any suitable material may be used as the release material, so long as it peels away freely from the adhesive substance 24, 26, leaving the adhesive substance in a manner suitable for adhering to a surface. Most preferably, paper, such as wax paper, is used as the release material.

Shield or cover 32 is attached to at least a portion of the photograph so as to protect the photograph from its environment and to prevent accelerated degradation of the photograph due to elements in the atmosphere and due to human fingerprints. Most preferably, shield 32 covers substantially the entire front face 21 of photograph 20. See FIGS. 1–3. Any suitable shield can be used which affords some protection to the indicia. Suitable materials include plastic and some forms of transparent paper, cellophane, transparent resins or the like.

Shield 32 may be attached to front surface 21 of photograph 20 by any suitable means such as by gluing. Most preferably, shield 32 comprises adhesive substance 34 on one side of the shield. See FIGS. 1, 3, 5. Release material 36 (FIG. 5), such as paper, is removably attached to the adhesive substance 34. Any suitable release material 36 may be used so long as release paper 36 peels away freely from its attached adhesive substance 34, leaving adhesive substance 34 in a manner suitable for adhering to a surface.

Preferably, shield 32 comprises at least one substantially transparent portion, wherein the transparent portion overlies at least a portion of front surface 21 of photograph 20, but preferably the transparent portion overlies all of front surface 21 of photograph 20, when the shield 32 is placed over photograph 20. As shown in FIGS. 1–2, most preferably, the entire shield is transparent.

A method for making decorative article 10 comprises the following steps. Housing 12 having at least an indicia receiving surface 18 is provided and indicia 20, such as a photograph, having front face 21 is adhered to at least a portion of indicia receiving surface 18 such that front surface 21 of photograph 20 faces outward from housing 12. Protective covering 32 is adhered to at least a portion of front surface 21 of photograph 20. See FIG. 1.

The step of adhering photograph 20 to indicia receiving surface 18 comprises the following steps. Double-sided material 22 having an adhesive substance 24, 26 (FIGS. 1, 3) on both sides is supplied. Release paper 28 (FIG. 4) is removed from one side of the adhesive substance 24 so as to expose the adhesive substance to the environment. The exposed adhesive substance 24 is placed in contact with at least a portion of indicia receiving surface 18 so as to adhere the double-sided material to indicia receiving surface 18. Release paper 30 (FIG. 4) is removed so as to expose adhesive substance 26. Rear surface 23 of photograph 20 is placed in contact with at least a portion of exposed adhesive substance 26 so as to allow photograph 20 to be housed within housing 12. See FIGS. 1, 3.

Adhering protective covering 32 comprises the following steps. Protective covering 32 is supplied having adhesive substance 34 on one side and release material 36 removably attached to adhesive substance 34 (FIG. 5). Release material 36 is removed from covering 32 so as to expose adhesive substance 34 to the environment. At least a portion of adhesive substance 34 of protective covering 32 is placed in contact with front surface 21 of photograph 20 so as to adhere protective covering 32 to photograph 20. FIGS. 1–3.

Most preferably, protective covering 32 is adhered to at least a portion of front surface 21 of photograph 20 after photograph 20 has been adhered to at least a portion of adhesive substance 26. One could, however, attach shield 32 to photograph 20, and then place photograph 20 into contact with adhesive substance 26.

It should be understood by those skilled in the art that obvious modifications can be made without departing from the spirit of the invention. Accordingly, reference should be made primarily to the accompanying claims, rather than the foregoing specification, to determine the scope of the invention.

We claim:

1. A decorative article, comprising:

a housing having an indicia receiving surface;

indicia having a front and back surface, the indicia at least partially disposed on the indicia receiving surface such that the front surface of the indicia is directed outward from the housing;

an adherent material comprising two sides and an adhesive substance on both sides, which adheres at least a portion of the back surface of the indicia at least partially to the indicia receiving surface; and a flexible substantially transparent shield, attached to at least a portion of the front surface of the indicia, for protecting the indicia.

2. The decorative article of claim 1, wherein the shield includes an adhesive for adhering the shield to the indicia.

3. The decorative article of claim 1, wherein the indicia receiving surface is flat.

4. The decorative article of claim 3, wherein the indicia receiving surface is recessed within the housing.

5. The decorative article of claim 1, wherein the indicia comprises a photograph.

6. The decorative article of claim 1, wherein the decorative article further comprises means for hanging the article on a tree limb.

7. A decorative article, comprising:

a housing having an indicia receiving surface, wherein the indicia receiving surface is substantially planar and at least partially recessed inside the housing;

indicia having a front and back surface, the indicia at least partially disposed on the indicia receiving surface such that the front surface of the indicia is directed outward from the housing;

an adherent material comprising two sides and having an adhesive substance on both sides, which adheres at least a portion of the back surface of the indicia at least partially to the indicia receiving surface; and a flexible substantially transparent cover, attached to at least a portion of the front surface of the indicia, for shielding the indicia.

8. The decorative article of claim 7, wherein the indicia comprises a photographic image.

9. The decorative article of claim 8, wherein the cover further includes an adherent for adhering the cover to the indicia.

10. The decorative article of claim 9, wherein the decorative article further comprises means for hanging the article.

11. A method for making a decorative article, comprising the following steps:

providing a housing, the housing having an indicia receiving surface, the indicia receiving surface being at least partially recessed inside the housing;

adhering indicia, the indicia having a front surface and a back surface, to at least a portion of the indicia receiving surface such that the front surface of the indicia faces outward from the housing;

adhering a flexible protective covering to at least a portion of the front surface of the indicia and attaching a hook to the housing so that the article may be suspended.

12. The method of claim 11, wherein the step of adhering the indicia to the indicia receiving surface comprises the following steps:

supplying double-sided material having an adhesive substance on both sides, and release material removably attached to the adhesive substance on each side of the double sided material;

removing one of the release materials so as to expose the adhesive substance to the environment;

placing at least a portion of the exposed adhesive substance in contact with the indicia receiving surface;

removing the second of the release materials so as to expose the adhesive substance to the environment; and placing at least a portion of the back surface of the indicia in contact with at least a portion of the exposed adhesive substance.

13. The method of claim 12, wherein the step of adhering the protective covering comprises the following steps:

supplying a substantially transparent protective covering having an adhesive substance on a side and a release material removably attached to the adhesive substance;

removing the release material from the covering so as to expose the adhesive substance to the environment; and placing at least a portion of the adhesive substance of the protective covering in contact with the front surface of the indicia so as to adhere the protective covering thereto.

14. The method of claim 13, further comprising adhering the protective covering to at least a portion of the front surface of the indicia after the indicia has been adhered to at least a portion of the indicia receiving surface.

15. The method of claim 13, further comprising adhering the protective covering to at least a portion of the front surface of the indicia before the indicia has been adhered to at least a portion of the indicia receiving surface.

* * * * *